United States Patent [19]

Sayles

[11] Patent Number: 4,655,860

[45] Date of Patent: Apr. 7, 1987

[54] A PROCESSING METHOD FOR INCREASING PROPELLANT BURNING RATE

[75] Inventor: David C. Sayles, Huntsville, Ala.

[73] Assignee: The United States of America as represented by the Secretary of the Army, Washington, D.C.

[21] Appl. No.: 484,105

[22] Filed: Apr. 1, 1983

[51] Int. Cl.[4] ..... C06B 21/00; C06B 45/10

[52] U.S. Cl. ..... 149/19.92; 264/3.1

[58] Field of Search ..... 149/19.9, 19.92; 264/3 R

[56] References Cited

U.S. PATENT DOCUMENTS

| | | | |
|---|---|---|---|
| 3,932,242 | 1/1976 | Bartley et al. | 149/19.9 |
| 3,943,208 | 3/1976 | Ratté et al. | 149/19.92 |
| 3,953,260 | 4/1976 | Braun et al. | 149/19.92 |
| 4,070,212 | 1/1978 | Mackey et al. | 149/19.9 |
| 4,070,213 | 1/1978 | Cucksee et al. | 149/19.92 |
| 4,090,893 | 5/1978 | Cucksee et al. | 149/19.9 |
| 4,092,189 | 5/1978 | Betts | 149/19.92 |
| 4,099,376 | 7/1978 | Japs | 149/19.9 |
| 4,216,039 | 8/1980 | Pierce | 149/19.9 |

*Primary Examiner*—Edward A. Miller

*Attorney, Agent, or Firm*—John H. Raubitschek; Werten F. W. Bellamy; Freddie M. Bush

[57] ABSTRACT

The effectiveness of the burning rate accelerator, iron oxide ($Fe_2O_3$), is enhanced, and a markedly improvement in the mechanical properties of a propellant composition are simultaneously achieved as a result of grinding a composite propellant paste in a roller mill instead of in a conventional sigma blade propellant mixer. The propellant paste is composed of a hydroxyl-terminated polybutadiene prepolymer, fluid-energy mill-ground ammonium perchlorate, dioctyl adipate, aluminum oxide, isophthaloyl bis-1-(2-methylaziridine), and iron oxide. The final product has a higher stress capability, higher strain capability, higher modulus, and higher gel fraction, and a burning rate that is about 80% higher as compared with sigma blade propellant ground and mixed propellant.

1 Claim, No Drawings

A PROCESSING METHOD FOR INCREASING PROPELLANT BURNING RATE

DEDICATORY CLAUSE

The invention described herein may be manufactured, used, and licensed by or for the Government for governmental purposes without the payment to me of any royalties thereon.

BACKGROUND OF THE INVENTION

Composite propellants which employ hydroxyl-terminated polybutadiene as the binder ingredient have been extensively modified by variations of the other propellant ingredients to achieve the desired burning rates and properties for specific uses.

Other changes in manufacturing techniques, particularly relating to the oxidizer particle size reduction and control, such as fluid-energy mill-ground ammonium perchlorate, have produced significant improvements in burning rates. Additionally, the bonding efficiency has been improved with the use of grinding aids employed in the manufacture of ammonium perchlorate. Also, when incorporating the ammonium perchlorate into the propellant composition, bonding agents selected from MR4, HX752, and BIDE or combinations thereof have been employed to produce improved propellant aging and low temperature physical properties in the cured propellant. U.S. Pat. No. 4,090,893, a commonly assigned patent to the United States of America as represented by the Secretary of the Army, issued to Cucksee et al on May 23, 1978, discloses isophthaloyl bis-1-(2-methylaziridine) (HX 752), BIDE (butylimidoethanal), and MT4 (reaction product of 2.0 moles of tris[1-(2-methylaziridinyl)]phosphine oxide, 0.7 mole adipic acid, and 0.3 mole tartaric acid) and the specific benefits derived for the propellant composition in which these bonding agents are employed.

Composite, hydroxyl-terminated polybutadiene propellants have employed carborane catalysts where higher burning rates are required; however, iron oxide which has been used over a considerable period of time became of somewhat lesser interest as a catalyst because of processing problems which resulted in variations in burning rates and the loss of certain desirable physical and mechanical properties.

Because iron oxide serves as a favorable catalyst for composite propellant compositions, an improved process which results in an improved burning rate and improved physical and mechanical properties for the propellant composition would be an attractive contribution to the propulsion industry.

Therefore, an object of this invention is to provide an improved process for mixing iron oxide catalyzed hydroxyl-terminated polybutadiene propellant compositions to achieve an improved burning rate and to achieve improved mechanical properties in the cured propellant composition.

SUMMARY OF THE INVENTION

The method of this invention enhances the effectiveness of iron oxide ($Fe_2O_3$) as a burning rate accelerator and simultaneously markedly improves the mechanical properties of the propellant composition. These marked improvements in burning rate and mechanical properties results when the propellant paste which is composed of the hydroxyl-terminated polybutadiene prepolymer, fluid-energy mill-ground ammonium perchlorate, dioctyl adipate and iron oxide are ground in a roller mill instead of in a conventional sigma blade propellant mixer.

DESCRIPTION OF THE PREFERRED EMBODIMENT

Marked improvements in burning rate and mechanical properties result when the propellant paste which is composed of the hydroxyl-terminated polybutadiene prepolymer, fluid-energy mill-ground ammonium perchlorate, dioctyl adipate and iron oxide are ground in a roller mill instead of in a conventional sigma blade propellant mixer. The final product has a higher stress capability, higher strain capability, higher modulus, and higher gel fraction. Examination of the polymers extracted from propellants made by the two different processes showed that the functionality, both number average and weight average increased, as did the gel fraction, but there were no other changes in functionality.

A comparison of the mechanical properties of propellants containing roller-milled iron oxide-hydroxyl-terminated polybutadiene paste as compared to sigma blade-milled paste is presented in Table I. The burning rate is increased from 1.6 ips to 2.8 ips, and stress capability is increased from 145 to 240 psi, strain at max stress is increased from 40 to 45%, and modulus is increased from 290 to 950 psi.

TABLE I

COMPARISON OF THE MECHANICAL PROPERTIES OF PROPELLANTS CONTAINING ROLLER MILLED IRON OXIDE-HYDROXYL-TERMINATED POLYBUTADIENE PASTE AS COMPARED TO SIGMA BLADE MILLED PASTE

| INGREDIENT/ CHARACTERISTIC | PROPELLANT A | PROPELLANT B |
|---|---|---|
| PROCESSING METHOD | SIGMA BLADE WT % | ROLLER MILL WT % |
| Hydroxyl-terminated polybutadiene, Antioxidant, Isophorone diisocyanate | 9.7 | 9.7 |
| Isophthaloyl bis-1-(2-methylaziridine) (HX-752) | 0.3 | 0.3 |
| Dioctyl adipate | 2.0 | 2.0 |
| Ammonium perchlorate | 86.0 | 86.0 |
| Aluminum | 1.0 | 1.0 |
| Iron oxide | 1.0 | 1.0 |
| Stress (psi) | 145 | 240 |
| Strain @ max stress (%) | 40 | 45 |
| Modulus (psi) | 290 | 950 |
| Burning rate (ips @ 2000 psi) | 1.6 | 2.8 |

The increase in burning rate along with the marked increase in desirable mechanical properties as a result of employing the roller mill is unexpected. Particularly, the use of a roller mill is unconventional in propellant processing since the sigma blade-milled paste technique has been the conventional technique for processing composite proellants as well as other propellants.

I claim:

1. A processing method comprising milling in a roller mill, a propellant composition paste comprised of about 9.7 weight percent of a hydroxyl-terminated polybutadiene prepolymer binder system with an antioxidant content of about 0.1% to about 0.6% of polybutadiene polymer, and of an isophorone diisocyanate curing agent content of about 0.5% to about 2.0% of polybutadiene polymer; isophthaloyl bis-1-(2-methylaziridine) of about 0.3 weight percent; dioctyl adipate of about 2.0 weight percent; fluid-energy mill-ground ammonium perchlorate of about 86.0 weight percent; aluminum powder of about 1.0 weight percent; and iron oxide of about 1.0 weight percent; and improving the burning rate and mechanical properties of the propellant composition as compared with using a sigma blade mixer to mix a like propellant composition paste, said improvement in burning rate being increased from about 1.6 inches per second to about 2.8 inches per second at about 2000 psi, said mechanical property of stress being increased from about 145 to about 245 psi, said mechanical property of strain at maximum stress being increased from about 40 to about 45%, and said mechanical property of modulus being increased from about 290 to about 950 psi.

* * * * *